United States Patent [19]

Takeda

[11] 4,427,885

[45] Jan. 24, 1984

[54] DOUBLE FOCUSSING MASS SPECTROMETER

[75] Inventor: Takehiro Takeda, Kyoto, Japan

[73] Assignee: Shimadzu Seisakusho Ltd., Kyoto, Japan

[21] Appl. No.: 325,189

[22] Filed: Nov. 27, 1981

[51] Int. Cl.[3] ..... H01J 49/32

[52] U.S. Cl. ..... 250/296

[58] Field of Search ..... 250/296, 396

[56] References Cited

U.S. PATENT DOCUMENTS

| | | | |
|---|---|---|---|
| 3,061,720 | 10/1962 | Ewald | 250/296 X |
| 3,194,961 | 7/1965 | Ewald et al. | 250/296 |
| 3,541,328 | 11/1970 | Enge | 250/396 |
| 3,866,042 | 2/1975 | Vastel | 250/296 |

*Primary Examiner*—Alfred E. Smith

*Assistant Examiner*—Jack I. Berman

*Attorney, Agent, or Firm*—Fidelman, Wolffe & Waldron

[57] ABSTRACT

A mass spectrometer comprising an ion source for producing an ion beam, an ion optical system having an entrance and an exit slit, and an ion detector. The ion optical system comprises a series combination of an energy dispersing unit and a mass dispersing unit. The energy dispersing unit comprises a toroidal electrical field having a deflection angle of 85° to 95° while the mass dispersing unit comprises a homogeneous magnetic field having a deflection angle of 85° to 95° and an entrance end face made concave as viewed from the entrance side of the ion beam when the apparatus is operated as a double focussing mass spectrometer of the reverse geometry type and an exit end face inclined 6° to 14° to the negative side from a position perpendicular to the axis of the ion optical system.

3 Claims, 3 Drawing Figures

DOUBLE FOCUSSING MASS SPECTROMETER

Figure 1:
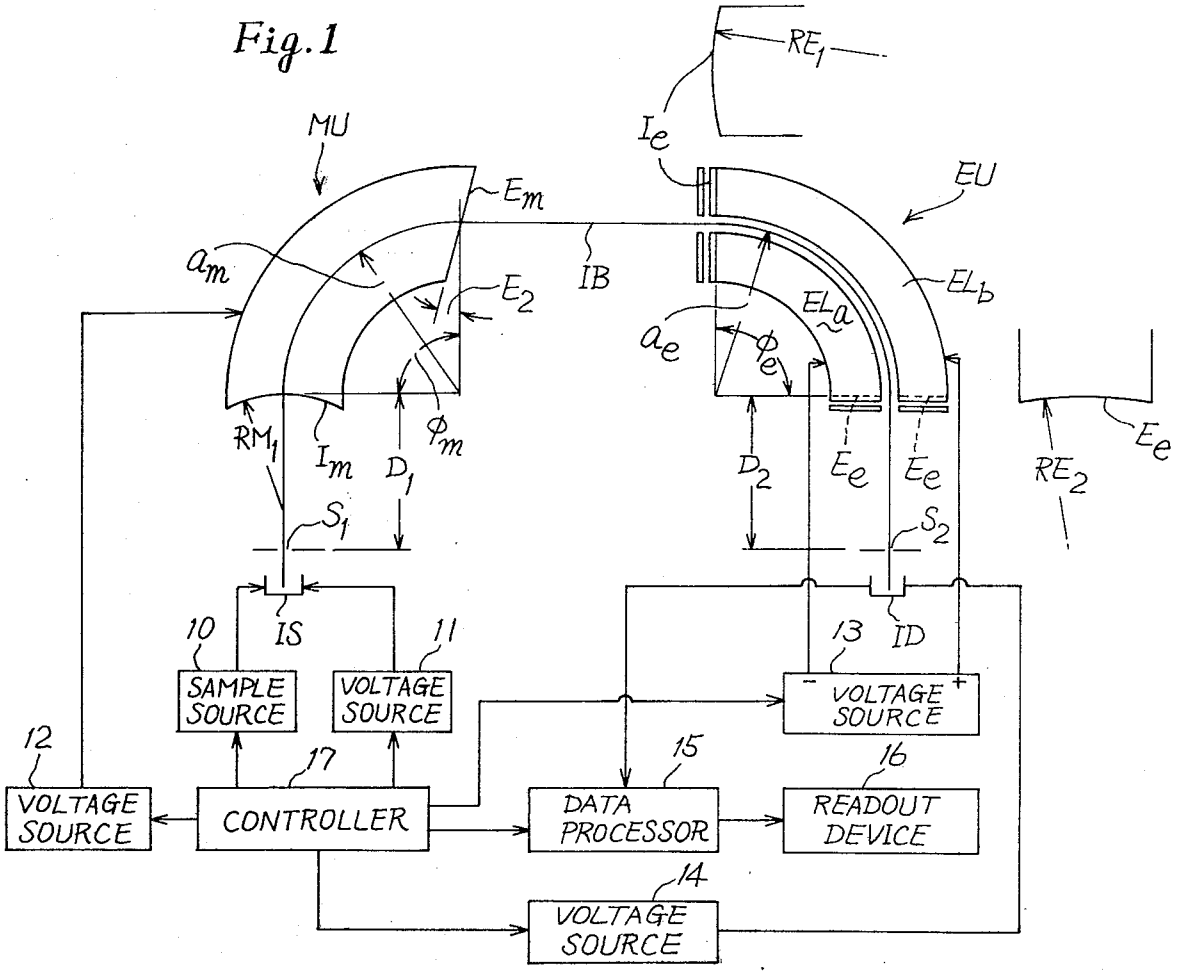

This invention relates to a mass spectrometer, and more particularly to a double focussing mass spectrometer which is provided with both an energy dispersing unit and a mass dispersing unit for separation of charged particles or ions according to their masses.

In one known mass spectrometer of this type, the energy dispersing unit comprises a cyclindrical electric field and the mass dispersing unit comprises a magnetic field. With this arrangement it is possible to focus the beam of ions produced by an ion source if the trajectory of the beam lies in the median plane, that is, the plane of the sheet of paper of FIG. 1 of the drawing. However, if the ions have a velocity component directed perpendicularly to the above-mentioned median plane as is usually the case with such ions the ion transmission coefficiency is low since no effective focussing action is exerted in the direction perpendicular to the above-mentioned median plane.

Various attempts have been made to improve the ion transmission coefficiency and resolution of the instrument. In one such improvement, the energy dispersing unit comprises a toroidal electric field while the mass dispersing unit has the entrance and exit end faces thereof formed into particular shapes, and the ion beams produced by an ion source are passed through the electric field into the magnetic field, so that the ion beams projected three-dimensionally from the source are converged in all directions including the above-mentioned perpendicular or vertical direction.

With this arrangement, however, all ion beams that emerge from a single point are not focussed exactly onto a single point. Such exact focussing is possible only with paraxial ion beams, that is, those beams which pass near the axis of the ion optical system of the instrument. The slit of an ion source practically has a certain area so that the edges of the slit are considerably away from the ion optical axis, and the ion beam emerging from a point at the edges diverges for a certain angle. This causes aberrations to appear in the image of the slit, which are not negligible in mass spectrometers of a high resolution type. Of various aberrations the most important are the second order aberrations.

To reduce the second order aberrations it has been proposed to use a toroidal electric field in the energy dispersing unit and in the mass dispersing unit a magnetic field the entrance and exit end faces of which are inclined from the perpendicular position to the axis of the ion optical system.

In a double focussing mass spectrometer of the conventional type (which will be referred to as the C-DF/MS hereinafter) in which the ion beam passes first through the electric field and then through the magnetic field, the above arrangement can considerably improve the transmission coefficiency and attain a high resolution.

Recently, however, there has been developed in the field of mass spectroscopy what is called a collision activation method, which must be carried out by a double focussing mass spectrometer of the reverse geometry type (which will be referred to as the R-DF/MS hereinafter) in which the ion beam passes first through the magnetic field and then through the electric field.

Accordingly, the primary object of this invention is to provide an ion optical system which has small aberrations and is suitable for use in an R-DF/MS.

Another object of the invention is to provide an ion optical system which can advantageously be used in either a C-DF/MS or an R-DF/MS, with small aberrations which remain substantially unchanged when the advancing direction of the ion beam has been reversed.

Another object of the invention is to provide a double focussing mass spectrometer having a new and improved ion optical system which provides the instrument with a higher ion transmission coefficiency and a higher resolution than the conventional instruments have.

Another object of the invention is to provide an R-DF/MS which can be converted into a C-DF/MS without materially changing the aberrations of the ion optical system.

Another object of the invention is to provide a double focussing mass spectrometer which is easy to manufacture and reliable in operation.

An additional object of the invention is to provide an R-DF/MS which can be used as a single focussing mass spectrometer by operating the mass dispersing unit alone.

In a double focussing mass spectrometer there are so many parameters which determine the aberrations of the ion optical system that determination of the values for the parameters that minimize the aberrations is generally conducted in the following manner.

To begin with, a certain value is selected for each of the parameters and the aberrations are calculated with the selected values. Then the values of the parameters are changed a little and the aberrations are again calculated with the new values to see how the aberrations have changed. New values which are expected to further reduce the aberrations are again selected for the parameters so that similar calculations to those mentioned above are conducted. The operation is repeated until a set of values of the parameters are found which give minimum aberrations. The calculations are complicated and repeated many times so that they are usually conducted by an electronic computer.

Briefly stated, the mass spectrometer of the invention comprises an ion source for producing an ion beam, an optical system having an entrance and an exit slit, and an ion detector. The ion optical system comprises a series combination of an energy dispersing unit and a mass dispersing unit. The energy dispersing unit comprises a toroidal electric having a deflection angle of 85° to 95° while the mass dispersing unit comprises a homogeneous magnetic field having a deflection angle of 85° to 95° and an entrance end face made concave as viewed from the entrance side of the ion beam when the apparatus is operated as an R-DF/MS and an exit end face inclined 6° to 14° to the negative side from a position perpendicular to the axis of the ion optical system.

Figure 2:
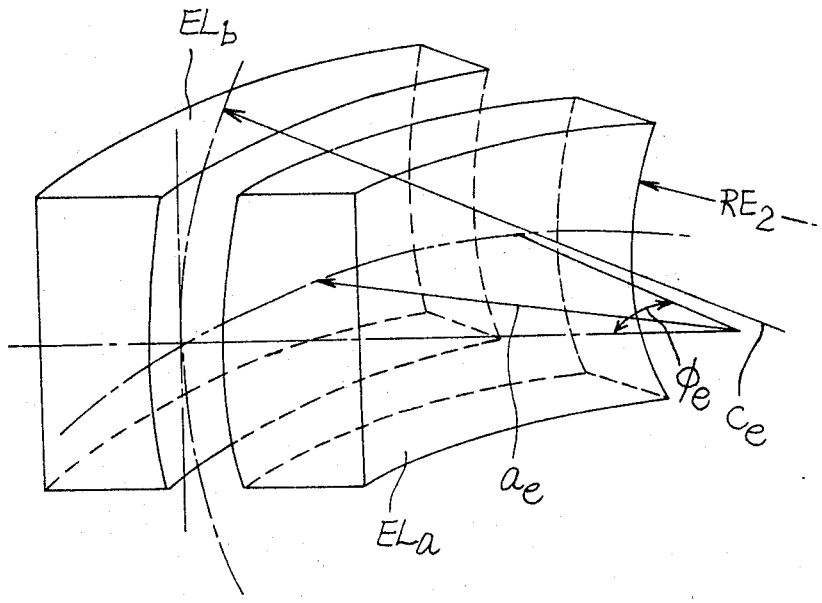
Figure 3:
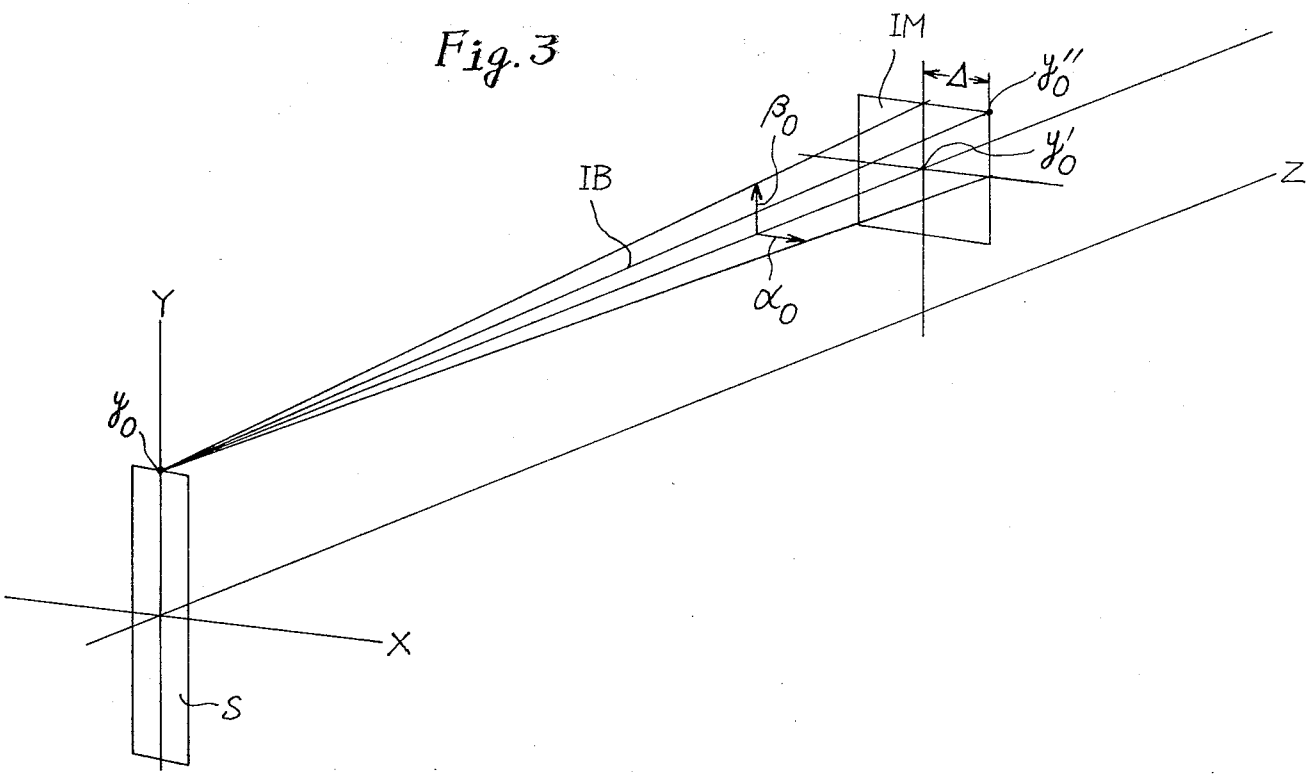

The invention will be described in detail with reference to the accompanying drawing, wherein;

FIG. 1 schematically shows one embodiment of the invention, in which the electric and magnetic fields are shown in top plan view, with side elevational views of the entrance and exit end portions of the toroidal electrodes being shown beside the top plane view;

FIG. 2 is a schematic perspective view of the toroidal electrodes shown in FIG. 1; and FIG. 3 is a schematic perspective view of the ion optical system of a double focussing mass spectrometer stretched linearly for easiness of illustration.

Referring first to FIG. 1 there is schematically shown a double focussing mass spectrometer of the invention comprising a mass dispersing unit MU which provides a generally sector-shaped magnetic field and an energy dispersing unit EU which comprises a pair of toroidal electrodes $EL_a$ and $EL_b$.

An ion source IS produces an ion beam IB in a well known manner. When the mass spectrometer is to operate as the reverse geometry or R-type (to which the collision activation mass spectrometer belongs), the ion beam IB passes through an entrance slit $S_1$, the mass dispersing unit MU, the energy dispersing unit EU and then an exit slit $S_2$ so as to enter an ion detector ID.

When the apparatus functions as the conventional or C-type, the positions of the ion source IS and the ion detector ID are reversed or interchanged so that the ion source is positioned where the ion detector ID is in FIG. 1 and the ion detector is positioned where the ion source IS is in FIG. 1, and the entrance and exit end faces of the electric magnetic fields in FIG. 1 become the exit and entrance end faces thereof, respectively.

A sample source 10 supplies a sample to be analyzed into the ion source IS, which is energized from a voltage source 11. The ion beam IB passing through the entrance slit Sis directed to the mass dispersing unit MU, which is energized from a voltage source 12. Across the pair of electrodes $EL_a$ and $EL_b$ a voltage source 13 impresses a voltage so that the ion beam emerging from the energy dispersing unit EU is focussed onto the exit slit $S_2$ so as to be detected by the ion detector ID.

The ion detector ID is energized by a voltage source 14 and upon detection of the ion of a particular mass number the ion detector produces a corresponding output electrical signal, which is applied to a data processor 15. The processed data is available from a readout device 16. A controller 17 controls the above-mentioned voltage sources, the sample source and the data processor.

The mass dispersing unit MU and the energy dispersing unit EU together with the slits $S_1$ and$S_2$ constitute the ion optical system of the mass spectrometer, the axis of which is shown coinciding with the ion beam IB in FIG. 1. In the magnetic field MU the ion beam has an orbital radius $a_m$. The magnetic field MU has an entrance end face $I_m$ and an exit end face $E_m$, and a deflection angle of $\phi_m$. The entrance end face $I_m$ is made concave as viewed from the ion source IS while the exit end face $E_m$ is inclined an angle $E_2$ relative to a plane perpendicular to the optical axis. The concave end face $I_m$ has a radius of curvature $RM_1$, and the center of the concave end face $I_m$ is spaced a distance $D_1$ from the entrance slit $S_1$.

In the electric field EU the ion beam has an orbital radius $a_e$. Each of the toroidal electrodes $EL_a$ and $EL_b$ has a curved entrance end face $I_e$ whose radius of curvature is $RE_1$ and a curved exit end face $E_e$ whose radius of curvature is $RE_2$, as shown in the profile views of the opposite end portions of the electrodes given in FIG. 1. The electric field has a deflection angle $\phi_e$ and a toroidal constant $C_1$.

The radius of curvature of the end faces $I_m$, $E_m$, $I_e$ and $E_e$ in both magnetic and electric fields has a negative value when it is concave as viewed from the ion source IS. In FIG. 1 the end face $I_e$ has a positive value. The angle $E_2$ of the end face $E_m$ of the magnetic field has a negative value as it is inclined as in FIG. 1. The toroidal constant $C_1$ is given as $a_e/c_e$, that is, the ratio of the above-mentioned ion orbital radius $a_e$ to the radius of curvature $c_e$ of the equipotential surface in the vertical direction in the electric field as shown in FIG. 2. In a spherical electric field, $C_1=a_e/c_e=1$.

FIG. 3 schematically shows the ion optical system of a double focussing mass spectrometer. For simplicity and easiness of illustration, the optical axis is shown linearly stretched as the Z-axis, with the X-axis lying in the median plane and the Y-axis extending perpendicularly to the X- and Z-axes.

The entrance slit is shown at S. Let a point $y_o$ be on the upper edge of the slit and on the vertical central line thereof or the Y-axis. Ideally, the image of the point $y_o$ is formed at a point $y_o'$ in the plane of the exit slit. Practically, however, the ion beam IB emerging from the point $y_o$ diverges out horizontally for an angle $\alpha_o$ and vertically for an angle $\beta_o$ so as to form an image IM having a certain area in the plane of the exit slit. Actually, the image IM is formed at the vertically opposite side of or below the Z-axis but shown as it is for simplicity and easiness of illustration and explanation. Let the edge of the spread image IM be represented by a point $y_o''$ thereon. The horizontal distance $\Delta$ the point $y_o''$ is spaced from the ideal image point $y_o'$ causes aberration, which reduces the resolution of the instrument.

If six second order aberration coefficients $A_{\alpha\alpha}$, $A_{\alpha\delta}$, $A_{\delta\delta}$, $A_{yy}$, $A_{y\beta}$ and $A_{\beta\beta}$ are used, the distance or aberration $\Delta$ can be expressed as:

$$\Delta=a_m[|A_{\alpha\alpha}\cdot\alpha_o^2|+|A_{\alpha\delta}\cdot\alpha_o\cdot\delta_o|+|A_{\delta\delta}\cdot\delta_o^2|+|A_{yy}(y_o/a_m)^2|+|A_{y\beta}(y_o/a_m)\beta_o|+|A_{\beta\beta}\cdot\beta_o^2|] \quad (1)$$

where $\alpha_o$ is the angle for which the ion beam emerging from the slit $S_1$ diverges horizontally in the median plane; $\delta_o$ is the energy width of the ion, that is, $\Delta V/V_{ac}$ where $V_{ac}$ is the accelerating voltage of the ion beam, and $\Delta V$ is the energy spread width of the ion beam; $\beta_o$ is the angle for which the ion beam emerging from the slit $S_1$ diverges vertically in the Y-Z plane in FIG. 3; and $y_o$ is the height at which the ion beam emerges from the slit $S_1$ along the Y-axis. The above six coefficients are functions of the previously mentioned parameters $a_e$, $a_m$, $\phi_e$, $\phi_m$, $RM_1$, $E_2$, $RE_1$, $RE_2$, $D_1$, $C_1$, and $D_2$.

In accordance with the invention, the angles $\phi_e$ and $\phi_m$ are about 90° in order to make it easier to manufacture the respective units. The ion transmission coefficiency can be improved by reducing the coefficients $A_{yy}$, $A_{y\beta}$ and $A_{\beta\beta}$ which are particularly large when a cylindrical electric field is used.

Taking the above into consideration the six aberration coefficients have been calculated with concrete values of the above-mentioned parameters as given below. The results are as follows:

(A) The values of the parameters:

| $a_e/a_m$ | $\phi_e$ | $\phi_m$ | $RM_1$ | $D_1$ | $E_2$ |
|---|---|---|---|---|---|
| 0.825 | 90° | 90° | $-0.8a_m$ | $1.0599a_m$ | −7.0° |
| $RE_1$ | $RE_2$ | $D_2$ | $C_1$ | | |
| $-0.952a_e$ | $-1.25a_e$ | $1.0880a_m$ | 0.5 | | |

In the above table, $D_1$ is the distance between the entrance slit $S_1$ and the entrance end face $I_m$ of the magnetic field; and $D_2$ is the distance between the exit end face $E_e$ of the electric field and the exit slit $S_2$.

(B) When the apparatus was operated as the R-DF/MS, the following values of the second order aberration coefficients resulted from the above values of the parameters:

| $A_{\alpha\alpha}$ | $A_{\alpha\delta}$ | $A_{\delta\delta}$ | $A_{yy}$ | $A_{y\beta}$ | $A_{\beta\beta}$ |
|---|---|---|---|---|---|
| 0.003 | −0.007 | 0.704 | −0.007 | 0.005 | −0.309 |

When the above values of the aberration coefficients were substituted into the equation (1), with $\alpha_o=1/250$ radian, $\delta_o=1/2000$, $y_o=1$ mm and $\beta_o=1/1000$ radian, we obtained $\Delta=0.115$ μm.

(C) When the apparatus was operated as the C-DF/MS, the following values of the second order aberration coefficients resulted:

| $A_{\alpha\alpha}$ | $A_{\alpha\delta}$ | $A_{\delta\delta}$ | $A_{yy}$ | $A_{y\beta}$ | $A_{\beta\beta}$ |
|---|---|---|---|---|---|
| 0.004 | −0.011 | −0.462 | 0.187 | 0.045 | 0.008 |

Calculation conducted in a manner similar to that in the above case (B) yielded $\Delta=1.022$ μm.

Similar calculations were conducted with different values selected for some of the parameters, as follows:

(A) The values of the parameters:

| $a_e/a_m$ | $\phi_e$ | $\phi_m$ | $RM_1$ | $D_1$ | $E_2$ |
|---|---|---|---|---|---|
| 0.825 | 95° | 90° | $-0.8a_m$ | $1.08803a_m$ | −7.0° |
| $RE_1$ | $RE_2$ | $D_2$ | $C_1$ | | |
| $-1.0a_e$ | $-1.25a_e$ | $1.02815a_m$ | 0.5 | | |

(B) When the instrument was operated as the R-DF/MS, the following values of the parameters were obtained:

| $A_{\alpha\alpha}$ | $A_{\alpha\delta}$ | $A_{\delta\delta}$ | $A_{yy}$ | $A_{y\beta}$ | $A_{\beta\beta}$ |
|---|---|---|---|---|---|
| 0.11 | −0.23 | 0.70 | 0.13 | 1.07 | 1.77 |

Calculation conducted in the same manner as in the previous example yielded $\Delta=2.61$ μm.

For comparison similar calculations were conducted with a double focussing mass spectrometer particularly designed for use as a C-DF/MS, with the exit end face of the magnetic field (corresponding to the entrance end face $I_m$ in the R-DF/MS shown in FIG. 1) being flat, that is, $RM_1=\infty$ and obliquely crossing the ion beam at the angle of 35°.

(A) The following values were selected for the parameters:

| $a_e/a_m$ | $\phi_e$ | $\phi_m$ | $RM_1$ | $D_1$ | $E_2$ |
|---|---|---|---|---|---|
| 0.99 | 88.6° | 88.0° | ∞ | $1.078a_m$ | −10° |
| $RE_1$ | $RE_2$ | $D_2$ | $C_1$ | | |
| $-1.515a_e$ | $-0.515a_e$ | $1.6259a_m$ | 0.5 | | |

(B) When the apparatus was used as the C-DF/MS, we obtained the following values ofthe second order aberration coefficients:

| $A_{\alpha\alpha}$ | $A_{\alpha\delta}$ | $A_{\delta\delta}$ | $A_{yy}$ | $A_{y\beta}$ | $A_{\beta\beta}$ |
|---|---|---|---|---|---|
| −0.001 | −0.006 | 0.001 | −0.059 | 0.037 | −1.718 |

Calculation conducted in a manner similar to that in the embodiment of the invention yielded $\Delta=0.681$ μm.

(C) When the apparatus was used as the R-DF/MS, the following values of the second order aberration coefficients resulted:

| $A_{\alpha\alpha}$ | $A_{\alpha\beta}$ | $A_{\delta\delta}$ | $A_{yy}$ | $A_{y\beta}$ | $A_{\beta\beta}$ |
|---|---|---|---|---|---|
| 0.002 | −0.010 | 0.009 | 1.511 | 8.655 | 12.539 |

The value of Δ was 18.729 μm.

In order to attain the effects of the invention the above- mentioned parameters can have the following ranges:

$$0.75 \leqq \frac{a_e}{a_m} \leqq 0.9$$

$$85° \leqq \phi_e \leqq 95°$$

$$85° \leqq \phi_m \leqq 95°$$

$$-a_m \leqq RM_1 \leqq -0.5a_m$$

$$-14.0° \leqq E_2 \leqq -6.0°$$

$$-a_e \leqq RE_1 \leqq a_e$$

$$-2a_e \leqq RE_2 \leqq 0.6a_e$$

$$0.85a_m \leqq D_1 \leqq 1.25a_m$$

$$0.45 \leqq C_1 \leqq 0.55$$

Preferably, $RE_1$ and $RE_2$ have the following ranges:

$$-a_e \leqq RE_1 \leqq -0.5a_e,\ 0.5a_e \leqq RE_1 \leqq a_e$$

$$-2a_e \leqq RE_2 \leqq -a_e,\ 0.2a_e \leqq RE_2 \leqq 0.6a_e$$

As is apparent from the foregoing comparison between the prior art arrangement and that of the invention, the aberration $\Delta=0.115$ μm in the apparatus of the invention used as the reverse geometry or R-type is improved greatly over or becomes more than 150 times better than the aberration $\Delta=18.729$ μm in the prior art apparatus used as the R-type and about 6 times better than the aberration $\Delta=0.681$ μm in the prior art apparatus used as the conventional or C-type. The aberration $\Delta=1.022$ μm in the apparatus of the invention used as the C-type is about 20 times better than the aberration $\Delta=18.729$ μm in the prior art apparatus used as the R-type and not very bad as compared with the aberration $\Delta=0.681$ μm in the prior art apparatus used as the C-type. In short, the aberration is greatly reduced in the mass spectrometer of the invention whether it is used as the R-type or the C-type.

As is apparent from the foregoing description, the double focussing mass spectrometer of the invention comprises an energy dispersing unit and a mass dispersing unit both having a deflection angle of about 90°. The energy dispersing unit comprises a pair of toroidal electrodes having a toroidal constant $C_1$ of 0.45 to 0.55 and an entrance end face $I_e$ whose radius of curvature $RE_1$ is between $-a_e$ and $a_e$ and an exit end face $E_e$ whose radius of curvature $RE_2$ is between $-2a_e$ and $0.6a_e$, and the mass dispersing unit comprises a magnetic field having an entrance end face $I_m$ formed into a concave surface whose radius of curvature $RM_1$ is between $-a_m$ and $-0.5a_m$ and an exit end face $E_m$ inclined an angle $E_2$ of −6° to −14°. Thus, the double focussing mass spectrometer of the invention has a higher degree of resolution than has ever been attained in the R-type and enables analysis of unknown substances with a higher degree of precision and accuracy.

The mass spectrometer of the invention can be used as either the reverse geometry type or the conventional type by merely exchanging the positions of the ion source and the detector, so that it is quite simple and easy to provide either type of the double focussing mass spectrometer, with resulting great advantages in the design and manufacturing process of the apparatus.

In the mass spectrometer of the invention, since the deflection angle of the electric field and that of the magnetic field are about 90 degrees, the space required to accommodate the ion optical system can be reduced so that the apparatus as a whole can be made more compact than otherwise.

When the mass spectrometer of the invention is used as an R-DF/MF, it can also be used as a single focussing mass spectrometer by providing an ion detector between the mass dispersing unit MU and the energy dispersing unit EU.

As is obvious to those skilled in the art, in the specification and claims the terms "entrance" and "exit" are used with respect to the direction of advancement of the ion beam when the apparatus is used as the R-DF/MS.

When the apparatus is used as the C-DF/MS, however, the terms "entrance" and "exit" should be taken to mean or replaced by "exit" and "entrance," respectively. For example, the "entrance" end face $I_m$ of the magnetic field when the apparatus is used as the R-DF/MS should be taken as the "exit" end face of the magnetic field when the apparatus is used as the C-DF/MS.

What I claim is:

1. A double focussing mass spectrometer comprising an ion optical system having an entrance slit and an exit slit and an ion detector, said ion optical system comprising a series combination of an energy dispersing unit and a mass dispersing unit, said energy dispersing unit comprising a toroidal electric field having a deflection angle of 85° to 95° and a toroidal constant of 0.45 to 0.55, and said mass dispersing unit comprising a homogeneous magnetic field having a deflection angle of 85° to 95°, a concave entrance end face having a radius of curvture of $-a_m$ to $-\frac{1}{2}a_m$ where $a_m$ is the ion orbital radius in said magnetic field, and a flat exit end face inclined at an angle of 6° to 14° to the negative side from a position perpendicular to the optical axis of said ion optical system, the ratio $a_e/a_m$ where $a_e$ is the ion orbital radius in said electric field, being between 0.75 and 0.9 and the distance between the entrance end face of said magnetic field and said entrance slit being between $0.85a_m$ and $1.25a_m$.

2. The double focussing mass spectrometer of claim 1, wherein said toroidal electric field has curved entrance and exit end faces, the radius of curvature $RE_1$ of said entrance end face being between $-a_e$ and $a_e$ while the radius of curvature $RE_2$ of said exit end face is between $-2a_e$ and $0.6a_e$.

3. The double focussing mass spectrometer of claim 1, further including a second ion detector capable of being selectively disposed between said mass dispersing unit and energy dispersing unit to detect the ion beam emerging from said mass dispersing unit.

* * * * *